US007156794B2

(12) United States Patent
Hakooz

(10) Patent No.: US 7,156,794 B2
(45) Date of Patent: Jan. 2, 2007

(54) ERGONOMIC CONTACT ELEMENT FOR HOLDING A HAND OR A FOOT

(76) Inventor: Joe S. Hakooz, 204 Tobacco Farm Dr., Apex, NC (US) 27505-4858

( * ) Notice: Subject to any disclaimer, the term of this patent is extended or adjusted under 35 U.S.C. 154(b) by 359 days.

(21) Appl. No.: 10/872,650

(22) Filed: Jun. 21, 2004

(65) Prior Publication Data

US 2005/0282690 A1 Dec. 22, 2005

(51) Int. Cl.
*A63B 71/00* (2006.01)

(52) U.S. Cl. ..... 482/148; 482/79

(58) Field of Classification Search ..... 482/148, 482/79, 80, 34, 62, 44, 146, 14; D21/662, D21/665, 685, 688
See application file for complete search history.

(56) References Cited

U.S. PATENT DOCUMENTS 5,833,575 A 11/1998 Holslag
6,042,521 A 3/2000 DeGiorgis
6,709,368 B1 3/2004 Chue

OTHER PUBLICATIONS

Zen-Pro Foot and Leg Exerciser, offered for sale by Zen-Pro Ltd of Shillingford, United Kingdom.
Chattanooga Deluxe Exerciser, offered for sale by Promed Products of Atlanta, GA, USA.

*Primary Examiner*—Lori Amerson
(74) *Attorney, Agent, or Firm*—MacCord Mason PLLC

(57) ABSTRACT

A contact element designed to hold a foot or hand is capable of being attached to various devices and structures that require a contact element or elements. The contact element includes a contoured, shaped piece of material and is configured to be attached. In the preferred embodiment, the contoured, shaped piece of material is ergonomically designed and has the approximate shape of a portion of a hyperbolic paraboloid with a surface that is convex in one direction and concave in the perpendicular direction, thereby optimizing comfort, support, and contact with a person's foot or hand.

32 Claims, 1 Drawing Sheet

ERGONOMIC CONTACT ELEMENT FOR HOLDING A HAND OR A FOOT

BACKGROUND OF THE INVENTION (1) Field of the Invention

The present invention relates generally to contact elements between a person and a device and, more particularly, to a contact element for holding a foot or a hand while using a device.

(2) Description of the Prior Art

Typically, foot or hand contact elements for devices like exercise machines do not have an ergonomic design.

Prior art contact elements, such as pedals and the like, commonly employ a simple flat piece of material, perhaps with a piece of foam or padding attached to increase a person's comfort. However, the prior art does not appear to have optimized a contact element that maximizes comfort, support, and contact between a person's foot or hand and the contact element.

Prior art examples related to this invention are as follows:

U.S. Pat. No. 6,679,817 issued to Williams, Jan. 20, 2004 for Lower Body Exercise Device and Method describes a lower-body exercising device and method including a three-dimensional platform with a resilient means for providing a resistance-based workout while sitting at work, home or traveling is disclosed. Preferably, the invention is manufactured from a single piece of material, is designed to be wedge-like in shape, is compact in size so as to fit under a desk or table or airplane seat, and is constructed from polyurethane foam that provides resistance to a pushing force by the user during manipulation. The invention can be manipulated by pressing the soles of the feet alternately into the device, or together in a "pumping" motion. Optionally, the device is covered in a plush, washable upholstery material, and/or includes heating elements.

The Zen-Pro Foot and Leg Exerciser, offered for sale by Zen-Pro Ltd of Shillingford, United Kingdom, illustrates a foot holder. The device is not convex in the perpendicular direction, which is parallel to the user's foot's long axis, and therefore does not fully support a users foot.

None of the prior art describes a foot or hand holder that can be used with devices, such as exercise devices, and is optimized for comfort, support, and contact between a person's foot or hand and the foot or hand holder. Thus, there remains a need for a foot or hand holder having an ergonomic design that optimizes comfort, support, and contact between a person's foot or hand and the contact element.

SUMMARY OF THE INVENTION

The present invention is directed to a contact element optimized for comfort, support, and contact between a person's foot or hand and the contact element.

In the preferred embodiment, a contoured, shaped piece of material is ergonomically designed and has the approximate shape of a portion of a hyberbolic paraboloid wherein the surface of the contoured, shaped piece of material is convex in one direction and concave in the perpendicular direction thereby optimizing comfort, support, and contact with a person's foot or hand.

Thus, the present invention provides for a contact element with a contoured, shaped piece of material and a means for attachment; wherein the means for attachment is connected to the bottom of the contact element, and the contact element is capable of being attached to various devices and structures that require a contact element or elements.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
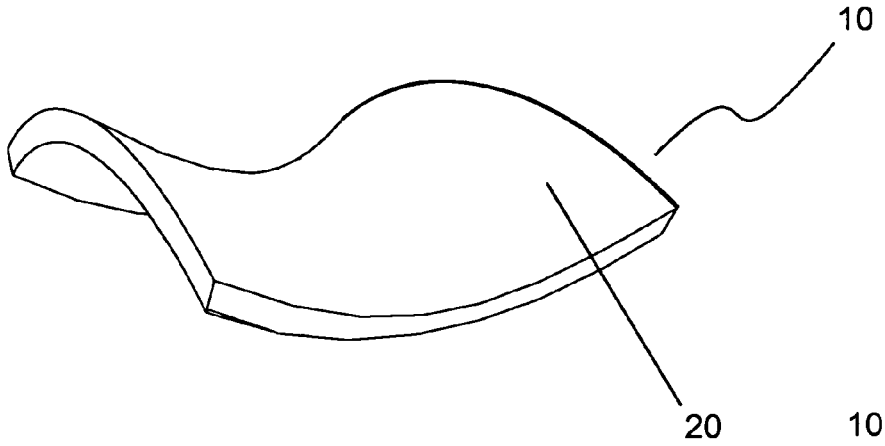
FIG. 1 is a perspective view of a contact element constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto.

Figure 2:
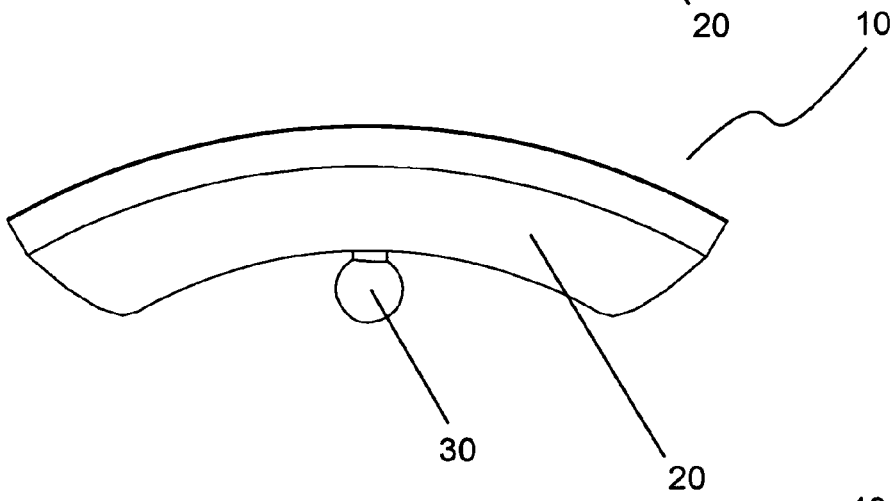
FIG. 2 is side view of a contact element constructed according to the present invention.

As best seen in FIG. 2, the present invention, generally referred to as 10, includes a contoured, shaped piece of material 20, and a means for attachment 30. The means for attachment is connected to the bottom of the contact element. Through the means of attachment, the contact element is capable of being attached to various devices and structures that require a contact elements for holding a person's foot or hand. Such devices and structures include, but are not limited to, exercise devices.

The means for attachment 30 may be designed to allow the contact element to be releasably attachable to other devices and structures. This design would facilitate repair by allowing a person to replace the contact elements and/or potentially allow a person to mount a different set of contact elements to better fit his or her foot or hand. The releasability of the contact elements could be accomplished by making the means for attachment a snap-fit or molded fastener. Preferentially, the present invention uses a ball and socket connection and releasability is attained by making the means for attachment from a sturdy flexible material, such as a rubber, allowing for reasonably easy snap-on and snap-off properties. Alternatively, a spring connection may be incorporated that uses the spring's tension to automatically return to a centered position when the present invention is not being used.

The contoured, shaped piece of material may be sized and constructed to fit a user's hand or foot, generally between about 8 cm to about 20 cm long and between about 10 cm to about 20 cm wide.

The contoured, shaped piece of material 20 should be ergonomic to optimize comfort, support, and contact with a person's foot or hand. This would be accomplished by contouring or shaping the contoured, shaped piece of material to hold a foot or hand. Additionally, there are techniques to increase the comfort and traction of a person's foot or hand contacting the contact element. The contoured, shaped piece of material may be coated or laminated with a soft material such as a gel or rubber. Alternatively, the contoured, shaped piece of material may be made of a partially soft matter, such as rubber. The material that the contoured, shaped piece of material is made from can be lightweight to accommodate a device requiring lightweight components. Also, the material that the shaped piece of the material is made from may be selected from the group including a resilient material, a memory retaining material, a viscoelastic material, an elastic material, and combinations thereof. An example of a resilient material is a polyurethane foam; an example of a memory retaining material is a material which retains its shape once deformed; an example of a viscoelastic material is a plastic; an example of an elastic material is a rubber.

The shape of the contoured, shaped piece of material may be similar to a portion of a three-dimensional surface. In the preferred embodiment, the portion of a three-dimensional surface is taken from a hyberbolic paraboloid, wherein the surface is convex in one direction and concave in the perpendicular direction. This shape should facilitate effective contact with a person's foot or hand by increasing the contact surface area between a person's foot or hand and the contact element. Additionally, this shape should add to the comfort felt by the person contacting the contact element.

Further improvements may be made to the present invention to optimize comfort, support, and contact with a person's foot or hand. These include, but are not limited to the following: 1) making the contoured, shaped piece of material out of a material that is moldable to a person's foot or hand; 2) custom-fitting the contoured, shaped piece of material to a specific person's foot or hand; and 3) making the contoured, shaped piece of material of a memory retaining material or a resilient material, such as a foam.

Figure 3:
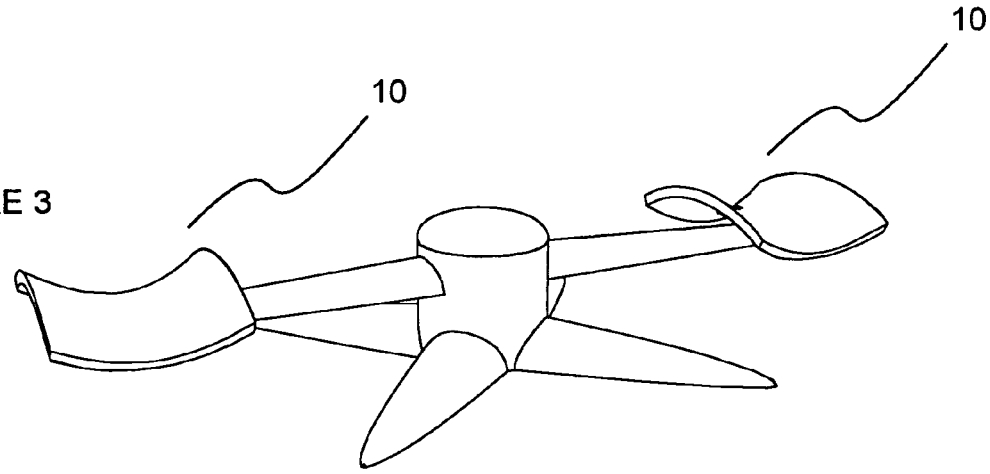
FIG. 3 is a perspective view of an exercise device having a contact element according to the present invention.

FIG. 3 demonstrates an example of an exercise device having the present invention attached as the exercise device's contact element for a person's foot or hand to operate the exercise device.

Certain modifications and improvements will occur to those skilled in the art upon a reading of the foregoing description. By way of example: 1) a massaging shaped piece of material may be utilized, such as one having flexible needles, gel type bubbles, or rollers; 2) the contact element may have the capability to receive a vibration-mode signal from an attached device; and 3) the contact element may have the capability to become warm (e.g. to function as a foot-warmer) via a signal from an attached device All modifications and improvements have been deleted herein for the sake of conciseness and readability but are properly within the scope of the following claims.

What is claimed is:

1. A contact element for providing a physical interface for a user to engage a device or machine, the contact element comprising a contoured, shaped piece of material, and a means for attachment;

wherein the means for attachment is connectable to the contact element, and the contact element is capable of being attached to various devices and structures that require a contact element or elements.

2. The contact element according to claim 1, wherein the contoured, shaped piece of material is ergonomic.

3. The contact element according to claim 1, wherein the contoured, shaped piece of material is formed from a unitary component.

4. The contact element according to claim 1, wherein the contoured, shaped piece of material is jointed.

5. The contact element according to claim 4, wherein the contoured, shaped piece of material is articulating.

6. The contact element according to claim 1, wherein the contoured, shaped piece of material is shaped to hold a foot or hand.

7. The contact element according to claim 1, wherein the contoured, shaped piece of material is coated with a soft material.

8. The contact element according to claim 1, wherein the contoured, shaped piece of material includes a gel.

9. The contact element according to claim 1, wherein the contoured, shaped piece of material is coated with a gel.

10. The contact element according to claim 1, wherein the contoured, shaped piece of material is laminated with a gel.

11. The contact element according to claim 1, wherein the contoured, shaped piece of material is partially soft.

12. The contact element according to claim 1, wherein the contoured, shaped piece of material is coated with rubber.

13. The contact element according to claim 1, wherein the contoured, shaped piece of material is made of rubber.

14. The contact element according to claim 1, wherein the contoured, shaped piece of material is lightweight.

15. The contact element according to claim 1, wherein the contoured, shaped piece of material is shaped similar to a portion of a three-dimensional surface.

16. The contact element according to claim 15, wherein the portion of a three-dimensional surface is from a hyberbolic paraboloid.

17. The contact element according to claim 1, wherein the contoured, shaped piece of material has at least one convex surface portion.

18. The contact element according to claim 1, wherein the contoured, shaped piece of material has at least one concave surface portion.

19. The contact element according to claim 1, wherein the contoured, shaped piece of material has both convex and concave surface portions.

20. The contact element according to claim 1, wherein the device requiring a contact element or elements is an exercise device.

21. The contact element according to claim 1, wherein the means for attachment is designed to allow the contact element to be releasably attachable to other devices and structures.

22. The contact element according to claim 21, wherein the means for attachment is a ball and socket connector.

23. The contact element according to claim 21, wherein the means for attachment is made from a sturdy flexible material.

24. The contact element according to claim 21, wherein the means for attachment is made from a rubber.

25. The contact element according to claim 1 wherein the means for attachment is a spring connector.

26. The contact element according to claim 1, wherein the contoured, shaped piece of material is moldable to a user's foot or hand.

27. The contact element according to claim 1, wherein the contoured, shaped piece of material is custom-fitted to a user's foot or hand.

28. The contact element according to claim 1, wherein the contoured, shaped piece of material is made of a memory retaining material.

29. The contact element according to claim 1, wherein the contoured, shaped piece of material is made of a resilient material.

30. The contact element according to claim 1, wherein the contoured, shaped piece of material is made of an elastic material.

31. The contact element according to claim 1, wherein the contoured, shaped piece of material is made of a viscoelastic material.

32. The contact element according to claim 21, wherein the contoured, shaped piece of material is between about 8 cm and 20 cm long and between about 10 cm to about 20 cm wide.

* * * * *